US007640759B2

(12) United States Patent
Robinson

(10) Patent No.: US 7,640,759 B2
(45) Date of Patent: Jan. 5, 2010

(54) CONDENSATE/WATER LEAK CONTROL SWITCH

(76) Inventor: Joe D. Robinson, 1601 S. Market, Brenham, TX (US) 77833

( * ) Notice: Subject to any disclaimer, the term of this patent is extended or adjusted under 35 U.S.C. 154(b) by 269 days.

(21) Appl. No.: 11/801,273

(22) Filed: May 8, 2007

(65) Prior Publication Data

US 2007/0271935 A1 Nov. 29, 2007

Related U.S. Application Data

(60) Provisional application No. 60/802,675, filed on May 23, 2006.

(51) Int. Cl.
*F25D 21/00* (2006.01)

(52) U.S. Cl. ..... 62/150; 62/272; 62/291; 137/15.05; 137/68.11; 73/305; 73/306; 73/307; 210/86; 210/119; 210/121

(58) Field of Classification Search ..... 62/150, 62/272, 291; 137/68.11, 15.05; 210/119, 210/121, 86; 73/305, 306, 307
See application file for complete search history.

(56) References Cited

U.S. PATENT DOCUMENTS

| | | | | |
|---|---|---|---|---|
| 2,049,321 | A | 7/1936 | Sampson | |
| 3,200,388 | A | 8/1965 | Uhlig | |
| 3,995,472 | A | 12/1976 | Murray | |
| 4,001,531 | A * | 1/1977 | Crockett, Sr. | 200/61.04 |
| 4,246,575 | A | 1/1981 | Purtell et al. | |
| 4,888,455 | A | 12/1989 | Hanson | |
| 4,922,232 | A | 5/1990 | Bosich | |
| 4,939,504 | A | 7/1990 | Miller | |
| 5,477,018 | A | 12/1995 | Fries et al. | |
| 6,041,611 | A * | 3/2000 | Palmer | 62/286 |
| 6,950,032 | B1 | 9/2005 | Hewitt et al. | |
| 7,191,606 | B1 * | 3/2007 | Dwyer | 62/150 |
| 7,434,744 | B2 * | 10/2008 | Garozzo et al. | 236/51 |

* cited by examiner

*Primary Examiner*—Cheryl J Tyler
*Assistant Examiner*—Jonathan Koagel
(74) *Attorney, Agent, or Firm*—Gardere Wynne Sewell LLP

(57) ABSTRACT

An air conditioning system condensate collection pan or water leak containment pan electrical control switch includes a housing or frame for supporting a switch unit which includes an elongated actuator arm. The housing includes a slot disposed adjacent a distal end of the actuator arm for receiving a water soluble tablet engageable with the actuator arm to bias the arm into a predetermined position of the switch. Abnormal accumulation of condensate or leaking water dissolves the tablet and allows the actuator arm to move to a position to effect actuation of the switch. The switch may be connected to a control unit, a thermostat and/or to an alarm generator including a self-contained unit having battery powered audio and/or visual alarm devices, an on-off switch and a circuit test switch.

13 Claims, 3 Drawing Sheets

CONDENSATE/WATER LEAK CONTROL SWITCH

CROSS REFERENCE TO RELATED APPLICATION

This application claims the benefit of provisional application No. 60/802,675, filed: May 23, 2006.

BACKGROUND OF THE INVENTION

Several developments have taken place with regard to providing a control switch and/or an alarm circuit for detecting abnormal levels of water in air conditioning unit condensate collection pans and water leak containment pans for hot water heaters and the like.

However, there has been a continuing need for improvements in such devices including the provision of a device which may utilize a tablet which is readily dissolvable in water, and a control switch device which may be easily mounted in a condensate pan for an air conditioning cooling coil or a water containment pan for a hot water heater or the like. In particular, there has been a need for a control switch which can utilize a biocide composition tablet, such as of a type used in air conditioning condensate pans to minimize the accumulation of algae in the pan or an associated drain conduit, for example.

There has also been a need for a control switch device which will provide a signal to a thermostat or the like, and/or automatically disable a cooling mode of operation of an air conditioning system. Still further, there has been a need for a control switch which will provide an audible as well as a visual signal in the event of accumulation of abnormal amounts of water in a condensate collection pan or a water leak containment pan and which device may be periodically tested for operability and may be easily retrofitted to existing installations of air conditioning equipment, hot water heaters and similar equipment.

It is to the above-mentioned ends, as well as to provide other advantages in condensate pan and water leak containment pan control devices, that the present invention has been developed.

SUMMARY OF THE INVENTION

The present invention provides an improved control switch for providing a control or alarm signal as a result of abnormal levels of condensate collecting in an air conditioning system condensate collection pan or a water containment pan for apparatus such as hot water heaters and the like.

In accordance with one aspect of the present invention a water leak control switch is provided which includes a corrosion resistant housing or support structure which is adapted to utilize and support a water soluble tablet, such as a biocide composition tablet used in air conditioning condensate pans to minimize algae growth or the like. The control switch is easily mountable within a condensate collection pan or a water leak containment pan wherein the electrical components of the switch are not immersed in liquid but a switch actuator is engageable with a water soluble tablet or the like which is conveniently mounted for replacement and is operable to be dissolved readily if an accumulation of condensate, for example, reaches a predetermined level. The water soluble tablet support structure is conveniently arranged for placement of the tablet therein and the housing or support structure is configured to minimize the tablet inadvertently falling out of its working position.

In accordance with a further aspect of the present invention, there is provided a water leak control switch in combination with an alarm unit which is self-contained and may be mounted adjacent the control switch but in a position to be readily accessible to determine if an alarm signal is being provided and to test the operability of a control circuit. The alarm unit may be battery powered and include an on-off switch, audible as well as visual alarm devices, a test switch and compact construction to provide for economical production and ease of installation.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENTS

Figure 1:
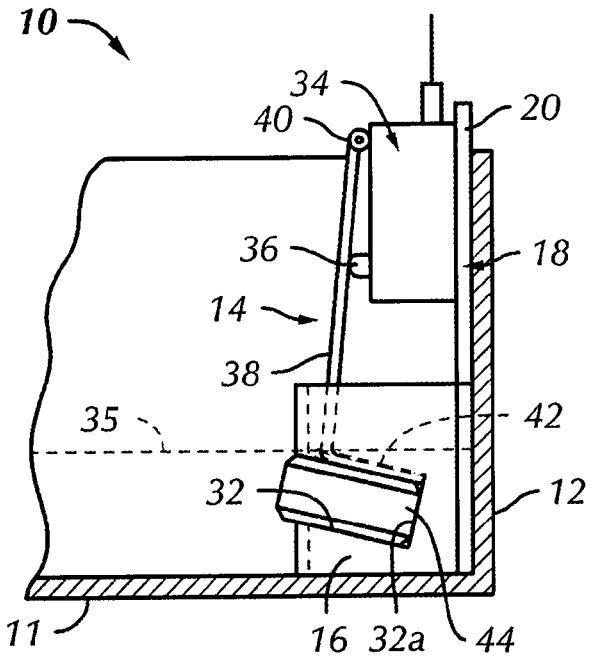
FIG. 1 is a side elevation of a water leak or water level alarm and control switch in accordance with the invention shown mounted within a condensate collection or water leak containment pan.

In the description which follows like elements are marked throughout the specification and drawing with the same reference numerals, respectively. The drawing figures are not necessarily to scale and certain features may be shown exaggerated in scale or in schematic form in the interest of clarity and conciseness.

Referring to FIG. 1, there is illustrated a portion of a condensate collection pan or water leak containment pan, generally designated by the numeral 10, having a bottom wall 11 and a side wall 12. FIG. 1 illustrates a control or alarm switch in accordance with the invention and generally designated by the numeral 14. The switch 14 is preferably characterized by a corrosion resistant non-buoyant support housing 16 including a base 18 having a generally planar first part 20 and suitably secured to sidewall 12 or just allowed to rest on bottom wall 11 in the position shown. Support housing 16 includes opposed flanges 22 and 24, see FIGS. 2 and 3 also which are joined by an arcuate part 26 having opposed legs 28 and 30 defining a receptacle characterized as a slot 32 which intersects arcuate part 26 as well as the legs 28 and 30. Slot 32 preferably extends at an acute angle with respect to the plane of base part 20 and the bottom wall 11 of pan 10, as shown particularly in FIGS. 1 and 2.

Control switch 14 includes a switch unit 34 suitably mounted on part 20 of housing 16 and disposed well above an expected liquid level 35, see FIG. 1, which might occur if a water using appliance developed a leak or if condensate collected from an air conditioning system, for example. Control switch unit 34 may be of a type commercially available such as sold under the trademark Microswitch. Control switch unit 34 includes a switch actuator part 36 and an elongated actuator lever 38 hingedly connected to the switch unit at 40 and engageable with the actuator part 36. Lever 38 may be spring biased to move about hinge or pivot point 40 in a clockwise direction, viewing FIG. 1, to a switch open position or a closed position, depending on the circuitry of the switch unit 34. The switch actuating lever 38 includes a distal depending part 42 which is engageable with a water soluble tablet element 44 comprising, preferably, a biocide composition which is readily water soluble and is of a type which is normally placed in air conditioning system condensate pans to minimize the accumulation of aquatic growths or the like. Slot 32 is dimensioned to receive tablet 44 and is angled in a direction wherein the base of the slot 32*a* is engageable with the tablet, see FIG. 1. The tablet 44 is thus angled downwardly toward surface or base 32*a* and is unlikely to leave the slot 32 due to vibration or inadvertent movement of the pan 10. Continuous spring pressure of the actuator arm 38 exerted on tablet 44 also aids in maintaining the tablet 44 in its working position shown in FIGS. 1 through 3. Switch unit 34 is adapted to be connected via suitable conductors 50 and 52, FIG. 2, to a suitable control unit 54. Control unit 54 may be associated with an air conditioning system, for example, an alarm circuit or other apparatus in which excessive of amounts of condensate or leaking water may accumulate within pan 10 and, upon actuation of switch 14, will result in the shutdown of such apparatus as well as possibly sounding an alarm.

Figure 2:
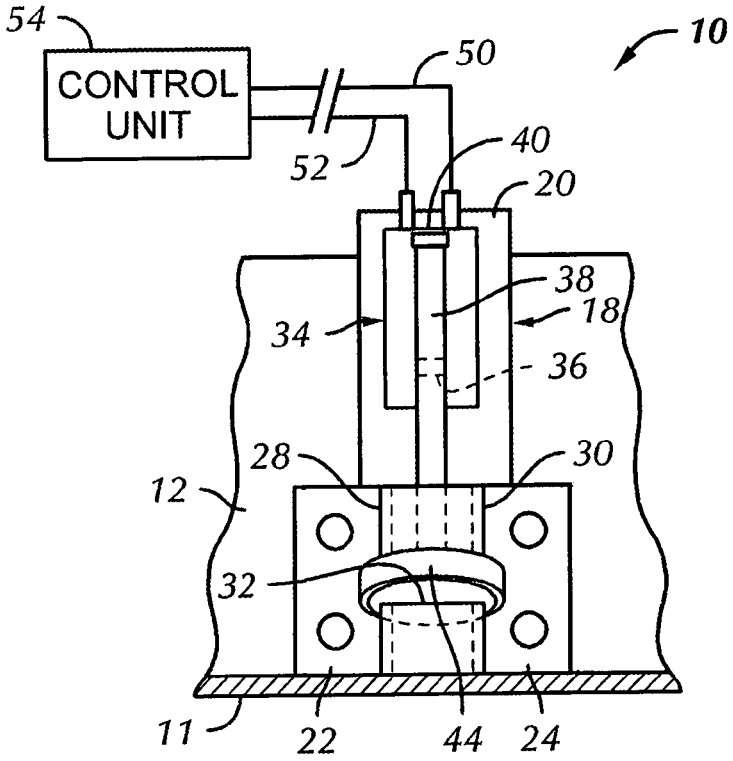
FIG. 2 is a front elevation of the switch shown in FIG. 1.
Figure 3:
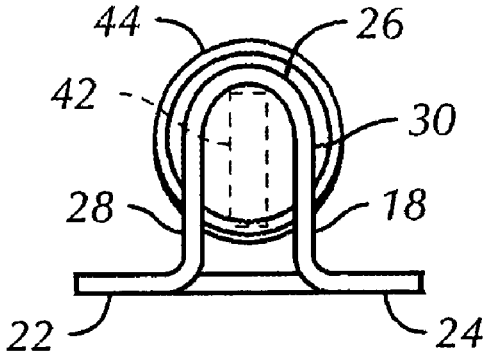
FIG. 3 is a bottom plan view of the switch shown in FIGS. 1 and 2.

As shown in FIGS. 1 and 2, the configuration of the control switch 14 is advantageous in that the parts of the switch which are likely to be in contact with condensate or other sources of water do not include electrical circuitry associated with the switch unit 34. However, the configuration of housing 16 also assures that tablet 44 will be thoroughly wetted and immersed in liquid as it rises to level 35 shown in FIG. 1.

In operation, the control switch 14 is adapted to be placed in condensate or liquid leakage containment pan 10, as illustrated in the drawings, suitably connected to control unit 54 or an alarm circuit and then armed by placing a tablet 44 in the slot 32 and in engagement with the spring biased switch actuator arm 38, 42. As condensate or leaking water collects in pan 10 it rises to a level wherein it contacts the tablet 44. Tablet 44 will dissolve rather rapidly allowing the actuator arm 42 to move in a clockwise direction, for example, viewing FIG. 1, and causing the switch unit 34 to open or close to thereby send a signal to control unit 54 which could result in shutdown of an air conditioning system or generation of an alarm signal to bring to the attention of the user of a system associated with pan 10 that an abnormal level of water is collecting in the pan. Once the cause of the leakage or condensate accumulation has been corrected a new tablet 44 may be placed in slot 32 with switch actuator lever 38 depressed and in engagement with the tablet in preparation for further operation of the switch.

Figure 4:
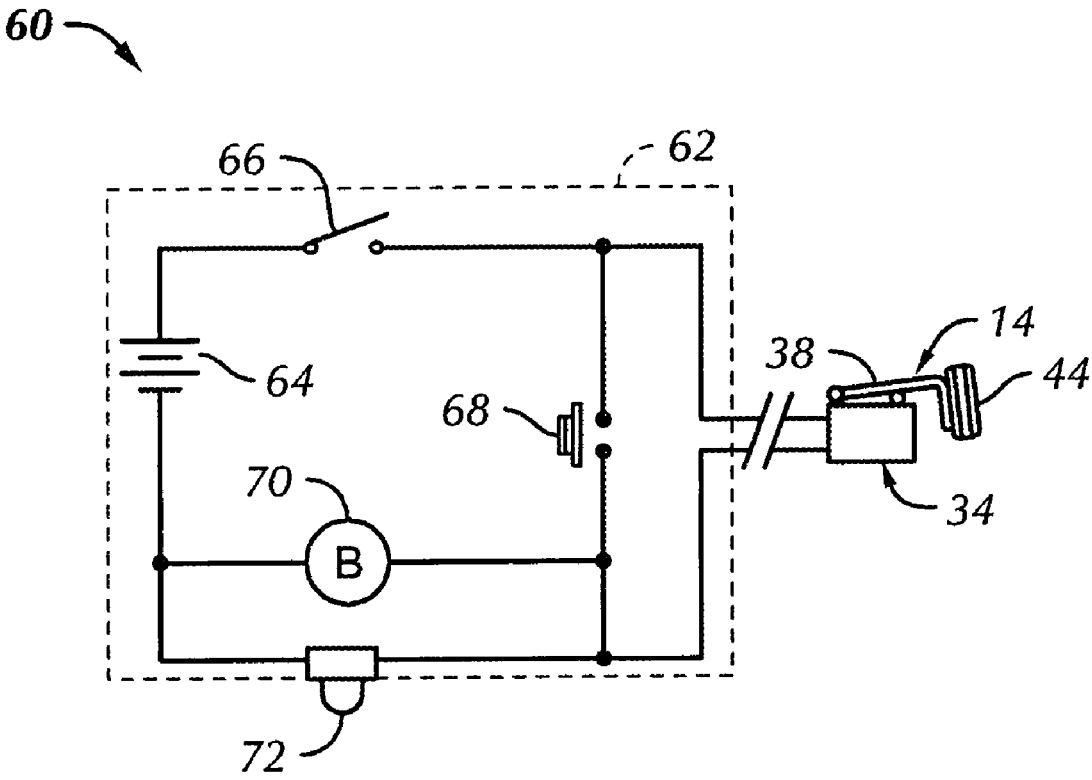
FIG. 4 is a schematic diagram of a control or alarm unit for providing a control or alarm signal generated by actuation of the switch of the present invention.

Referring briefly to FIG. 4, there is illustrated a self-contained alarm system, generally designated by the numeral 60, which may include a sealed enclosure 62 within which a circuit is provided including a source of power comprising a battery 64, an on-off control switch 66, a momentary push-button type test switch 68 and suitable alarm generating means, such as a buzzer or similar audio type alarm generator device 70. Additionally, a visual indicator 72 comprising a light emitting diode, for example, may be placed in parallel with the audio alarm generator 70. As shown in FIG. 4, control switch 14 is placed in circuit with the alarm generator so that when switch unit 34 closes audio and visual alarms are generated. Accordingly, the device or apparatus 60 may be installed with a control switch 14 in a location where at least one of an audio and visual signal may be detected if a malfunction occurs which results in liquid accumulation in a condensate collection or leakage containment pan, such as the pan 10 shown in FIGS. 1 and 2 and described previously.

Figure 5:
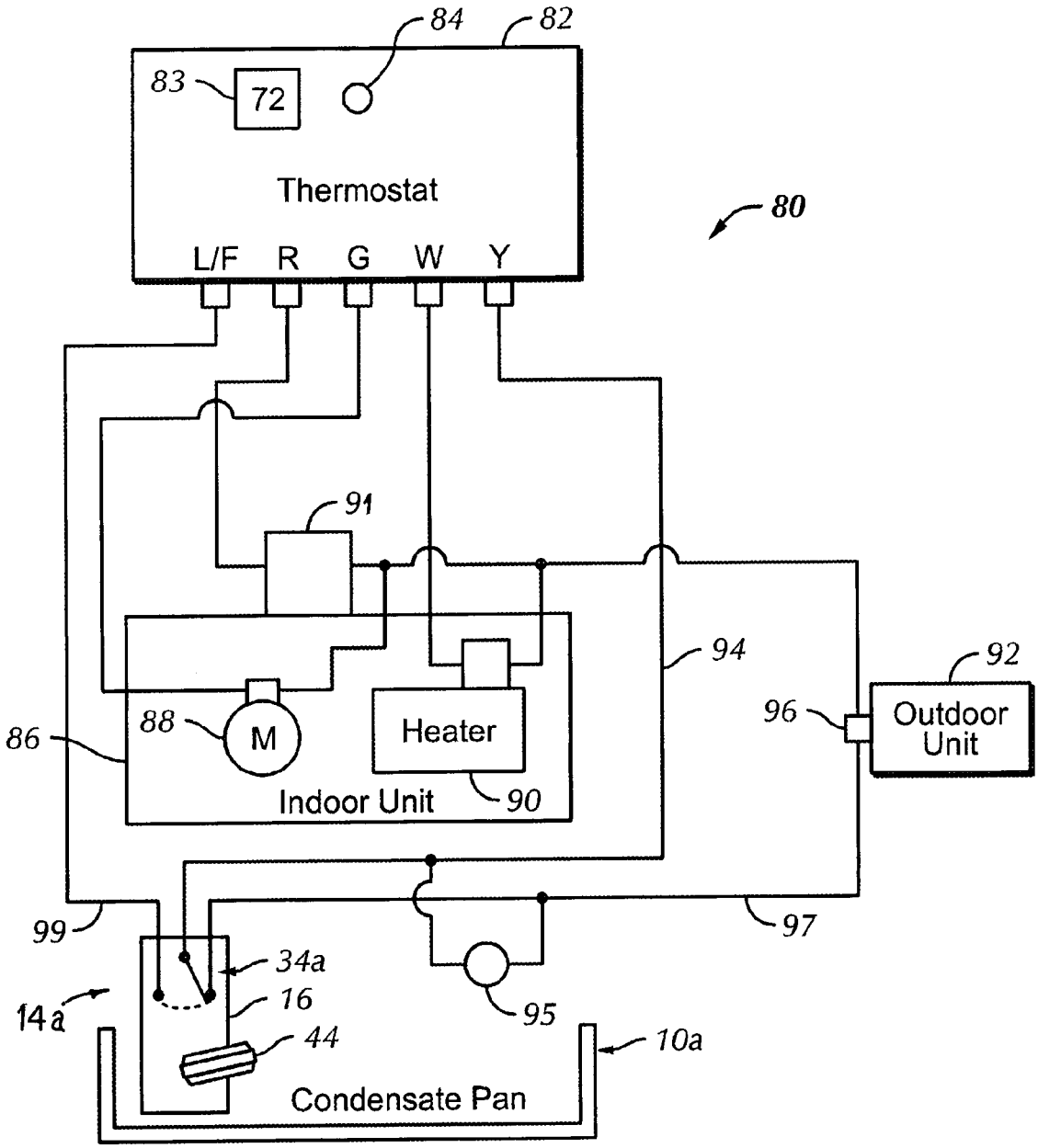
FIG. 5 is a schematic diagram of an air conditioning system including an alternate embodiment of a control switch in accordance with the invention.

Referring now to FIG. 5, there is illustrated an alternate embodiment of a control switch in accordance with the invention associated with a unit of heating, ventilating and air conditioning (HVAC) equipment, generally designated by the numeral 80. The unit of HVAC equipment 80 is characterized by a thermostat 82 having at least terminals identified by the letters L/F, R, G, W and Y in accordance with conventional thermostat terminal markings. Thermostat 82 includes a visual temperature display 83 and a visual indicator 84 for indicating a system fault condition. System 80 also includes a so-called indoor unit 86 including a circulating fan or blower 88 and a heater unit 90. An outdoor unit, such as a vapor compression condenser unit 92 is illustrated as being associated with the system 80. The indoor unit 86 would also include a cooling coil, not shown, operably connected to the outdoor unit for circulating a refrigerant fluid therebetween in a conventional manner.

An alternate embodiment of a control switch in accordance with the invention is associated with the system 80 and is generally designated by the numeral 14*a*. Switch 14*a* includes a switch unit 34*a* of the three way type supported in the housing 16 in place of the switch unit 34 and responsive to dissolving of the tablet 44 to move from the position shown in FIG. 5 to an alternate position. For example, low voltage control power is supplied for the system 80 from a transformer 91 connected to terminal R of thermostat 82 and providing electrical power to terminal Y when the air conditioning system 80 is operating in a cooling mode and there is a call for cooling effect. In this mode, electrical power is supplied from terminal Y via a conductor 94 to switch unit 34*a* and, in the position shown, power is supplied to an indicator light 95 and to a relay 96 of the outdoor unit 92 causing a conventional vapor compression compressor and condenser to begin furnishing working fluid to the indoor unit 86 to effect cooling operation. Moreover, if condensate collects in a condensate pan 10*a*, similar to the condensate pan 10, to a level which will dissolve the tablet 44 switch unit 34*a* will move to a position wherein power from thermostat terminal Y via conductor 94 will be conducted to a conductor 99 which is connected to the terminal L/F of thermostat 82 and will result in illumination of the indicator light 84. Simultaneously, control power is shut off between conductor 94 and conductor 97 leading to the relay 96 so that the outdoor unit will cease operation resulting in loss of cooling effect delivered by system 80, but also preventing additional collection of condensate in the condensate pan 10*a*. In this way, a user of the system 80 will be alerted to a fault condition and may take corrective action to eliminate the adverse effects of unwanted accumulation of condensate in the pan 10*a*.

The construction and operation of the switches 14, 14*a*, the alarm generator apparatus 60 and the system 80 are believed to be within the purview of one skilled in the art based on the foregoing description. Commercially available components may be utilized to construct the switches 14 and 14*a* except for the housing 16, and commercially available components may be used to, essentially, construct the apparatus 60 and system 80. The housing 16 is preferably formed of a suitable plastic having a density greater than water and may take other specific configurations while retaining the advantages described herein.

Although preferred embodiments of the invention, including a switch and alarm apparatus have been described in detail herein, those skilled in the art will also recognize that various substitutions and modifications may be made to the invention without departing from the scope and spirit of the appended claims.

What is claimed is:

1. A condensate and water leak control switch comprising:

a housing adapted for placement in a condensate collection or water leak containment pan;

an electrical switch unit including an actuator member supported on said housing;

said housing including a receptacle formed therein for receipt of a water soluble tablet, wherein said receptable comprises a slot formed in said housing at an acute angle with respect to the vertical to provide for biasing said tablet to remain in said slot, said tablet being engageable with said actuator member when placed in said receptacle whereby in response to accumulation of liquid in said pan, said tablet dissolves to allow said actuator member to change the condition of said switch unit to provide for generating one of a control signal and alarm signal, respectively.

2. The invention set forth in claim 1 wherein:

said actuator member comprises an elongated arm including a distal end part engageable with said tablet when placed in said receptacle.

3. The invention set forth in claim 1 including:

an alarm unit comprising a circuit including a battery connected to said switch unit and to an alarm generator, and at least one of a manually actuated on-off switch in said circuit for connecting said battery to said switch unit and a momentary pushbutton test switch for testing said circuit to verify operation of said alarm generator.

4. The invention set forth in claim 3 including:

a sealed enclosure containing said alarm generator, said test switch and said on-off switch, respectively.

5. The invention set forth in claim 3 wherein:

said circuit includes audible and visual signal generators, respectively.

6. A condensate and water leak control switch comprising:

a housing adapted for placement in a condensate collection pan or water leak containment pan;

an electrical switch unit including an actuator member supported on said housing;

said housing including a slot formed therein for receipt of a replaceable water soluble element wherein said slot is formed in said housing at an acute angle with respect to the vertical to provide for biasing said element to remain in said slot, said element being engageable with said actuator member, said actuator member comprises an elongated arm including a distal end part engageable with said element when placed in said slot whereby in response to accumulation of liquid in said pan, said element dissolves to allow said actuator member to move to a position to change the condition of said switch unit to generate one of a control signal and alarm signal.

7. The invention set forth in claim 6 including:

an alarm unit comprising a circuit including a battery connected to said switch unit and to an alarm generator, and at least one of a manually actuated on-off switch in said circuit for connecting said battery to said switch unit and a momentary pushbutton test switch for testing said circuit to verify operation of said alarm generator.

8. invention set forth in claim 7 including:

a sealed enclosure containing said alarm generator, said test switch and said on-off switch, respectively.

9. invention set forth in claim 7 wherein:

said circuit includes audible and visual signal generators, respectively.

10. A condensate and water leak control switch comprising:

a housing adapted for placement in a condensate collection pan or water leak containment pan;

an electrical switch unit including an actuator member supported on said housing;

said housing including a receptacle formed therein oriented at an acute angle with respect to vertical for receipt and biasing of a water soluble tablet in said receptacle, said tablet being engageable with said actuator member when placed in said receptacle whereby in response to accumulation of liquid in said pan, said tablet dissolves to allow said actuator member to change the condition of said switch unit to provide for generating one of a control signal and alarm signal; and an alarm unit comprising a circuit including a battery connected to said switch unit and to an alarm generator, and at least one of a manually actuated on-off switch in said circuit for connecting said battery to said switch unit and a test switch for testing said circuit to verify operation of said alarm generator.

11. invention set forth in claim 10 including:

a sealed enclosure containing said alarm generator, said test switch and said on-off switch, respectively.

12. invention set forth in claim 10 wherein:

said circuit includes audible and visual signal generators, respectively.

13. In an air conditioning system, including a thermostat, an indoor unit, an outdoor unit and a transformer for supplying control power between said thermostat and said outdoor unit, a condensate level control switch including a housing adapted for placement at a condensate collection pan of said air conditioning system, an electrical switch including an actuator, said housing including a receptacle oriented at an acute angle with respect to vertical for receipt and biasing of a water soluble tablet in said receptacle responsive to accumulation of liquid in said pan to dissolve and cause such switch to change from a position enabling power to be supplied to said outdoor unit to a position to generate a fault control signal to said thermostat to alert a user of said system that a fault condition has occurred comprising an excess accumulation of condensate in said pan.

* * * * *